United States Patent [19]

Dye

[11] 4,193,946

[45] Mar. 18, 1980

[54] MEANS FOR INCREASING CHOKE VALVE OPENING RATE

[75] Inventor: S. Owen Dye, Highland, Ill.

[73] Assignee: ACF Industries, Incorporated, New York, N.Y.

[21] Appl. No.: 965,257

[22] Filed: Dec. 1, 1978

[51] Int. Cl.[2] ..... F02M 1/10

[52] U.S. Cl. ..... 261/39 B; 123/119 F

[58] Field of Search ..... 261/39 E, 39 B; 123/119 F

[56] References Cited

U.S. PATENT DOCUMENTS

| | | | |
|---|---|---|---|
| 2,681,214 | 6/1954 | Eickmann | 261/39 B |
| 3,092,999 | 6/1963 | Eickmann et al. | 261/39 B |
| 3,762,385 | 10/1973 | Hollnagel | 261/144 |
| 3,947,531 | 3/1976 | Branigin | 261/39 E |

FOREIGN PATENT DOCUMENTS

| | | | |
|---|---|---|---|
| 913173 | 12/1962 | United Kingdom | 261/39 E |

*Primary Examiner*—Tim R. Miles
*Attorney, Agent, or Firm*—J. Joseph Muller

[57] ABSTRACT

Means (1) for decreasing the rate at which a carburetor choke valve (V) closes when the engine (E) on which the carburetor is installed is shut off. First and second spaced-apart horizontal passages (P1 and P2) respectively extend through the upper and lower ends of a housing (H) in which a bi-metal choke coil (B) is mounted. A third passage (P3) extends vertically through the housing and communicates at each end with one end of the respective first and second passages. The other end of the first and second passages are connected (15,17) to a water circulating passage (WP) in the engine whereby water circulating through the engine flows through the first, second, and third passages and some of the water heat is transmitted to the housing and the bi-metal coil so the coil cools at a slower rate than that at which it otherwise cools.

2 Claims, 3 Drawing Figures

MEANS FOR INCREASING CHOKE VALVE OPENING RATE

BACKGROUND OF THE INVENTION

This invention relates to carburetor choke valve controls and, more particularly, to slowing down the rate of choke valve closing when an engine on which the carburetor is installed is shut off.

On newly designed four-cylinder engines, the engine block is typically cast iron while the engine's intake manifold and the carburetor mounted on the manifold are a lighter weight material such as aluminum. Carburetors for use on four-cylinder engines include a choke valve and fast idle cam arrangement and as the engine heats up, the choke valve is gradually opened. As this occurs, the fast idle cam moves from its top to its bottom step. When the engine is shut off, the carburetor and manifold cool down to ambient temperature faster than the engine because of the differences in mass between them. Because the carburetor cools to ambient temperature, the fast idle cam is returned to its top step when the engine is restarted. If this occurs before the engine cools to ambient temperature, the engine will be difficult to start and when it does, it will run at a higher rpm than is necessary. Further, the operator can do nothing to control the rpm at which the engine runs. Since the air-fuel mixture supplied the engine at this time is rich, HC and CO emission levels are high and because the engine is running at a faster than necessary rate, fuel economy suffers.

SUMMARY OF THE INVENTION

Among the several objects of the present invention may be noted an improvement in a carburetor whereby a choke valve of the carburetor is closed at a slower than normal rate when the engine is shut off, the provision of such an improvement by which engine restarting is made easier and the engine, upon starting, operates at a proper rpm thereby improving fuel economy and helping reduce emissions, and the provisions of such an improvement which is readily incorporated in existing choke housings and does not unduly increase carburetor space requirements in a vehicle's engine compartment.

Briefly, a carburetor for an internal combustion engine has an unbalanced choke valve positioned at the inlet end of an air induction passage, a shaft on which the choke valve is mounted, a bi-metal coil to which the shaft is connected, the coil being responsive to engine temperature to exert a closing force on the choke valve which lessens as engine temperature increases whereby the choke valve gradually opens, a closed housing in which the coil is mounted, and means for heating the bi-metal coil when the engine is running thereby to open the choke valve. An improvement of the present invention comprises means for decreasing the rate at which the choke valve closes after the engine is shut off. The means includes means defining first and second spaced apart horizontal passages respectively extending through the housing at the upper and lower ends thereof, and a third passage extending vertically through the housing and communicating at each end with one end of the respective first and second passage. The other end of the first and second passages are connected to a water circulating passage in the engine whereby water circulating through the engine flows through the first, second, and third passages and some of the water heat is transmitted to the housing and the bi-metal coil so the coil cools at a slower rate than that at which it otherwise would. Other objects will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
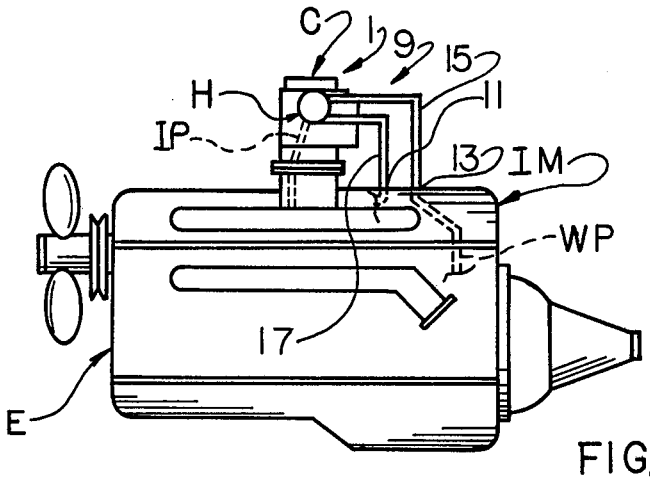
FIG. 1 is an illustration of a carburetor having an improvement of the present invention mounted on an intake manifold of an internal combustion engine.

Referring to the drawings, a carburetor C for an internal combustion engine E has an unbalanced choke valve V positioned at the inlet end of an air induction passage AP. The choke valve is disk shaped and is mounted on a shaft S. One end of shaft S is connected to a bi-metal coil B which is responsive to engine temperature to exert a closing force on the choke valve which lessens as engine temperature increases. The bi-metal coil is mounted in a closed housing H, the housing being cast to have an interior space in which the coil is mounted and a cap or end closure EC which closes the outer end of the housing. Means are provided for heating the bi-metal coil when the engine is running thereby to open the choke valve. The means may, for example, comprise an internal carburetor passage IP extending from the bottom surface of the carburetor, where it mounts to an engine intake manifold IM, to housing H so heat generated when the engine is running is transmitted to the housing to heat the coil. Or, the means may comprise an electrical heater (not shown) which is activated when the engine is started to heat the coil.

Operation of the bi-metal coil is as is well known in the art; viz, when the engine is started, the choke valve is moved from a closed to an initially open position and thereafter is moved to a fully open position against a gradually lessening closing force exerted on the choke valve by the bi-metal coil. When the engine is turned off, the bi-metal coil cools down from some elevated temperature to ambient temperature. As this occurs, the closing force exerted on the choke valve increases and the choke valve is moved from its fully open position to its closed position.

Figure 2:
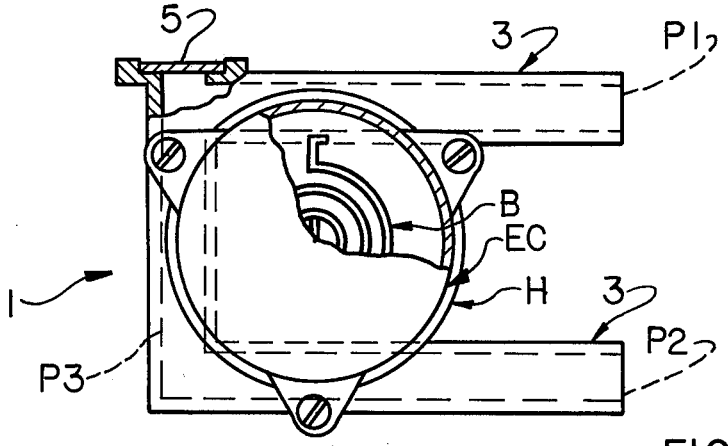
FIGS. 2 and 3 are front and side elevations respectively of a choke housing of the carburetor of FIG. 1 illustrating the improvement of the invention.
Figure 3:
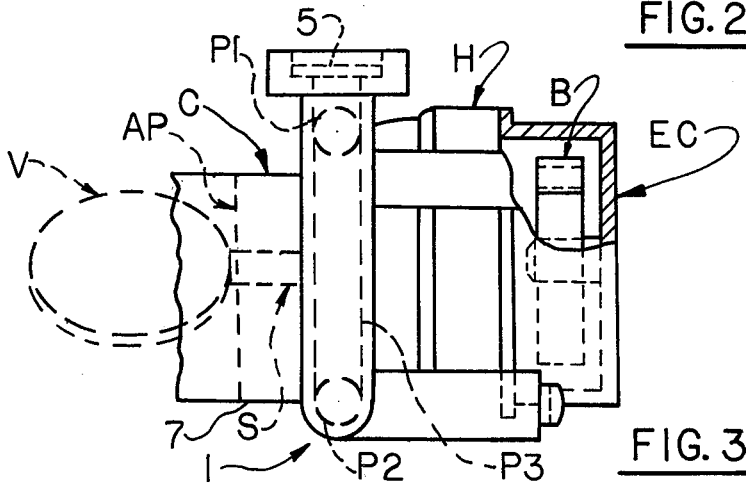

The improvement of the present invention comprises means 1 for decreasing the rate at which the choke valve closes after the engine is shut off. The means comprises means 3 defining first and second passages P1 and P2 respectively. The passages are horizontal and spaced apart from each other with passage P1 extending through housing H at the upper end of the housing and with passage P2 extending through the housing at its lower end. As shown in the drawings, the passages are parallel to each other. Means 3 further includes a third passage P3 which extends vertically through housing H (at the left side of the housing as viewed in FIG. 2). Each end of passage P3 communicates with one end of one of passages P1 and P2. Thus, the upper end of passage P3 communicates with the left end of passage P1 (as seen in FIG. 2) while the lower end of passage P3 communicates with the left end of passage P2.

Passages P1 and P2 are preferably integrally formed with housing H when it is cast. Alternately, the passages may be drilled out after the housing is cast as is passage P3. A plug 5 fits over the drill hole formed in the upper surface of housing H when passage P3 is made thereby to close off the hole. In addition, the passages are located inwardly of the location of bi-metal coil B and thus are nearer to the carburetor body 7 on which the housing is mounted.

Means 1 further includes a means 9 for connecting the other end of passages P1 and P2 (the right end of the passages as viewed in FIG. 2) to a water circulating passage WP of engine E. As shown in FIG. 1, the water passage is tapped into at two points, 11 and 13 respectively, and an appropriate fitting is attached to the engine at each point. A first water line 15 attaches to one of the fittings and connects to the right end of passage P1. A second water line 17 attaches to the other fitting and connects to the right end of passage P2. With engine E running, water circulating through the passage also circulates through housing H via passages P1, P2, and P3.

When the engine is turned off, water will continue to circulate through the passage and consequently through passages P1, P2, and P3. The water heat is transmitted to housing H and bi-metal coil B and decreases the rate at which the coil returns to its cold engine position. This, in turn, decreases the rate at which choke valve V returns to its closed position. Upon restarting of engine E, before it has cooled to ambient temperature, the fast idle cam (not shown) of the carburetor does not return to its top step and the air-fuel mixture supplied to start the engine will be leaner than it would be were the choke valve completely closed. This not only makes the engine easier to restart, but the engine idles at a lower rpm than it otherwise would. This promotes both fuel economy and reduced emissions.

I claim:

1. In a carburetor for an internal combustion engine, the carburetor having an unbalanced choke valve positioned at the inlet end of an air induction passage, a shaft on which the choke valve is mounted, a bi-metal coil to which the shaft is connected, the coil being responsive to engine temperature to exert a closing force on the choke valve which lessens as engine temperature increases whereby the choke valve gradually opens, a closed housing in which the coil is mounted, the housing being mounted to the body of the carburetor, and means for heating the bi-metal coil when the engine is running thereby to open the choke valve, the improvement comprising means for decreasing the rate at which the choke valve closes after the engine is shut off, the means including means defining first and second spaced apart horizontal passages respectively extending through the housing at the upper and lower ends thereof, the passages being substantially parallel to each other, a third passage extending vertically through the housing and communicating at each end with one end of the respective first and second passage and means connecting the other end of the first and second passages to a water circulating passage in the engine whereby water circulating through the engine flows through the first, second, and third passages and some of the water heat is transmitted to the housing and the bi-metal coil so the coil cools at a slower rate than that at which it otherwise cools, the three passages being inward of the bi-metal coil when the housing is mounted on the carburetor body, the water connecting means connecting to the outer end of both the first and second passages and the third passage connecting at each end with a respective inner end of the first and second passages.

2. The improvement as set forth in claim 1 wherein the first and second passages are integrally formed with the housing.

* * * * *